US006939656B2

(12) United States Patent
Tanaka et al.

(10) Patent No.: US 6,939,656 B2
(45) Date of Patent: Sep. 6, 2005

(54) METHOD FOR PRODUCING POLYMERIZED TONER

(75) Inventors: Katsutomo Tanaka, Yokohama (JP); Makoto Watanabe, Tokyo (JP); Keita Sensui, Kawasaki (JP)

(73) Assignee: Zeon Corporation, Tokyo (JP)

( * ) Notice: Subject to any disclaimer, the term of this patent is extended or adjusted under 35 U.S.C. 154(b) by 136 days.

(21) Appl. No.: 10/631,007

(22) Filed: Jul. 31, 2003

(65) Prior Publication Data

US 2004/0110081 A1 Jun. 10, 2004

(30) Foreign Application Priority Data

Aug. 9, 2002 (JP) ..... 2002-233213

(51) Int. Cl.[7] ..... G03G 9/08
(52) U.S. Cl. ..... 430/137.15; 430/137.17; 430/137.12
(58) Field of Search ..... 430/137.15, 137.17, 430/137.12

(56) References Cited

U.S. PATENT DOCUMENTS 3,763,021 A * 10/1973 Householder ..... 203/20
4,904,730 A * 2/1990 Moore et al. ..... 525/75
5,886,140 A * 3/1999 Olivares et al. ..... 528/485

FOREIGN PATENT DOCUMENTS

| | | |
|---|---|---|
| JP | 5-100485 | 4/1993 |
| JP | 5-289404 | 11/1993 |
| JP | 2001-117272 | 4/2001 |

* cited by examiner

*Primary Examiner*—Mark A. Chapman
(74) *Attorney, Agent, or Firm*—Armstrong, Kratz, Quintos, Hanson & Brooks, LLP

(57) ABSTRACT

Methods for producing a polymerized toners are provided, where, a dispersion including colored polymer particles obtained by polymerizing a polymerizable composition is treated stably in the process of reducing the remaining monomer, the resultant polymerized toners include a sufficiently low content of remaining monomer, and the resultant polymerized toners have excellent properties and are useful as developers for printing and copying. In the process of reducing the remaining monomer, the dispersion of the colored polymer particles is treated by stripping in the presence of a specific antifoaming agent.

13 Claims, No Drawings

METHOD FOR PRODUCING POLYMERIZED TONER

TECHNICAL FIELD

The present invention relates generally to a method for producing a polymerized toner, the toner being used for developing a latent image formed, for example, by electrophotography method, electrostatic recording method, and so on. The present invention relates, in particular, to a method for producing polymerized toner, where in such obtained toner remaining polymerizable monomer therein is remarkably reduced, and the toner has excellent properties, and where a dispersion of colored polymer particles obtained by polymerization of a polymerizable composition is treated by stripping stably.

RELATED ART

In an image-forming device in which an electro photography method or an electrostatic recording method is adopted, such as a copying device, a laser beam printer or a facsimile device, a developer is used to develop and visualize an electrostatic invisible image formed on a photosensitive member. The developer mainly consists of colored particles (a toner) where colorants, charge control agents, parting agents and the like dispersed in a matrix of a binder resin.

Methods for producing toners are roughly divided into two methods. One is a pulverizing method, which provides a pulverized toner, and the other is a polymerization method, which provides a polymerized toner. In the pulverizing method, the pulverized toner is produced by melt-mixing a thermoplastic resin with colorant and additives such as a charge control agent, a parting agent, and the like, then pulverizing the obtained mixture, and then classifying the obtained pulverized material into a powder of colored resin. In this method the thermoplastic resin is obtained by polymerizing a polymerizable monomer in advance. In the polymerization method, the polymerized toner is produced by: polymerizing a polymerizable composition in an aqueous dispersion medium, the polymerizable composition comprising a colorant, a polymerizable monomer and additives; and removing colored polymer particles from the obtained dispersion.

In either method, it is difficult to polymerize the polymerizable monomer completely in the polymerization step, and it is not avoidable that the polymerizable monomer still remains in the resultant toner. Even if the remaining polymerizable monomer in a toner (referred as "remaining monomer" in short thereafter) is in a very small amount, it raises some problems such as:

(i) deterioration of working environment and a bad smell caused from its vaporization by heat applicated at fixing of the toner;

(ii) a blocking of the toner during storage;

(iii) declination of flowability of the toner during developing and degradation of printed image;

(iv) increasing possibility of offset of the toner; and (v) increasing possibility of filming of the toner on the element of the image forming device.

The problems raised by remaining monomer is more serious in the polymerization method than in the pulverizing method. In the pulverizing method, it is easy to reduce remaining monomer from the mere thermoplastic polymer to be used as the binding polymer during preparing the polymer in advance by a heating or drying treatment. On the other hand, in the polymerization method, it is necessary to reduce the remaining monomer from the polymer (that is to say "colored polymer particles") including a colorant and additives such as a charge control agent and a parting agent. It is more difficult to reduce the remaining monomer from such colored polymer particles, than from the mere binding monomer, because the remaining monomer is easily absorbed in such a colorant and additives. Further, the condition of treatment to reduce the remaining monomer, such as heating treatment, is limited because the resultant polymerized toner is easy to aggregate. Recently, the polymerized toner which can be fixed at a still lower temperature has been demanded, which toner enables higher speed printing and higher quality of full color printing. However, it is very difficult to reduce the remaining monomer and at the same time prevent aggregation from such a toner that is suitable to fixing at lower temperature.

So far, many processes to reduce the remaining monomer from a polymerization monomer were proposed. For instance, Japanese laid open patent application 5-100,485 discloses a process in which, after a suspension polymerization, a suspension medium is reduced by distillation with blowing a saturated vapor of the suspension medium into a suspension including polymerized toner particles. However, there often arise some problems with this process: one problem is that a stable operation in this process is difficult because foaming is easily occurs at the interface between gas phase and liquid phase; another problem is that reducing efficiency of remaining monomer decreases because of the foaming; and another problem is degradation of properties of the resultant polymerized toner caused by an aggregation.

Japanese patent 2,923,280 discloses a process in which, after a suspension polymerization of a polymerizable composition in an aqueous medium, the aqueous medium is reduced by distillation after adding a silicone-antifoaming agent to the suspension including polymerized toner particles. It discloses, adopting this process: that the aqueous medium can be reduced by distillation with lower foaming at the interface between gas phase and liquid phase; and that the process does not cause any degradation of properties of the resultant toner.

Japanese laid open patent application 2001-117,272 discloses a process in which, after a suspension polymerization, a volatile material is reduced by stripping from the suspension including polymerized toner particles with agitating the suspension, wherein the agitator using for the agitating is placed with part of the blades outstanding over the surface of the suspension. They also disclose that: by adopting such a process, the volatile material in the polymerized toner can be reduced to less than 100 ppm with lower foaming at the interface between gas phase and liquid phase; and that the process does not cause any degradation of surface properties of the resultant toner, such as a lowered charge amount, caused by an antifoaming agent.

DISCLOSURE OF THE INVENTION

The inventors of the present invention found that the process, disclosed in Japanese patent 2,923,280, where a suspension is treated by stripping in the presence of a silicone-antifoaming agent, does actually cause some degradation of properties of the resultant toner. More specifically, they found that such a polymerized toner has a lowered charge amount and tends to cause a fog and a decreasing or varying printing density.

The inventors of the present invention found that such processes disclosed in the above-mentioned prior art are not sufficient yet, because, by adopting such processes, the remaining monomer in colored polymer particles cannot be reduced efficiently and to a sufficiently low content, with lower foaming at the interface between gas phase and liquid phase of the dispersion, including the colored polymer particles (which has the same meaning with "a polymerized toner" in the present invention). The inventors of the present invention also found that the remaining monomer in a polymerization monomer must be lower than 100 ppm (which can not be sufficiently low), preferably lower than 50 ppm, and more preferably lower than 30 ppm, for environmental safety. And the remaining monomer reducing process should be operated stably with lower foaming.

Therefore, the objective of the present invention is providing a method for producing a polymerized toner where, a dispersion, including colored polymer particles, obtained is treated stably in the process of reducing the remaining monomer, the resultant polymerized toner includes a sufficiently low content of remaining monomer, and the resultant polymerized toner has excellent properties.

The inventors of the present invention have performed various research to accomplish the objective and finally found: such a method for producing a polymerized toner where, after a process producing a dispersion of colored polymer particles, adopting such a process of reducing the remaining polymerizable monomer from the colored polymer particles, wherein tile dispersion is treated by stripping in the presence of at least one specific antifoaming agent; that such remaining monomer reducing process can be operated stably with lowering foaming sufficiently; and that the resultant polymerized toner has a high charge amount, does not cause a fog, and can provide a high printing density. Such a process of reducing a remaining polymerizable monomer is applicable for producing either an ordinary (other than core-shell structured) polymerized toner or a core-shell structure polymerized toner. The present invention is achieved on the basis of these findings.

According to the present invention, there are thus provided two methods for producing polymerized toners. The first one is A method for producing a polymerized toner, having:

a process P1 of producing a dispersion of colored polymer particles, the process further comprising a step S1 of polymerizing a polymerizable composition in an aqueous dispersion medium, which polymerizable composition has a colorant and a polymerizable monomer;

a process P2 of reducing the remaining polymerizable monomer from the colored polymer particles, the dispersion being treated by stripping in the presence of at least one antifoaming agent selected from a group consisting of fats-and-oils antifoaming agents, mineral oil antifoaming agents, polyether antifoaming agents, polyalkyleneglycol nonionic surfactants, emulsions consisting of fats-and-oils and polyalkyleneglycol nonionic surfactants, and emulsions consisting of mineral oils and polyalkyleneglycol antifoaming agents; and a process P3 of removing the colored polymer particles from the dispersion after treating by stripping. The second method is specialized for producing a core-shell structure polymerized toner and is described as:

A method for producing a polymerized toner according to the previously described method, wherein:

the process P1 further comprises the step S1 and a subsequent step S2 of polymerizing a polymerizable monomer in the presence of the resultant colored polymer particles of the step S1; and wherein the resultant colored polymer particles of the process P1 are core-shell structured.

The second method is described as:

A method for producing a core-shell structure polymerized toner, comprising:

a process P1 of producing a dispersion of core-shell structure colored polymer particles, the process further comprising a step S1 of polymerizing a polymerizable composition in an aqueous dispersion medium, which polymerizable composition contains at least a colorant and a polymerizable monomer, and a subsequent step S2 of polymerizing a polymerizable monomer in the presence of the resultant colored polymer particles of the step S1;

a process P2 of reducing a remaining polymerizable monomer from the core-shell structure colored polymer particles, the dispersion being treated by stripping in the presence of at least one antifoaming agent selected from a group consisting of fats-and-oils antifoaming agents, mineral oil antifoaming agents, polyether antifoaming agents, polyalkyleneglycol nonionic surfactants, emulsions consisting of fats-and-oils and polyalkyleneglycol nonionic surfactants, and emulsions consisting of mineral oils and polyalkyleneglycol antifoaming agents; and a process P3 of removing the core-shell structure colored polymer particles from the dispersion after treating by stripping.

DETAILED DESCRIPTION OF THE INVENTION

Process P1: Producing a dispersion of colored polymer particles.

The method for producing a polymerized toner of the present invention comprises a process P1 of producing a dispersion of colored polymer particles, the process comprising a step S1 of polymerizing a polymerizable composition in an aqueous dispersion medium, which the polymerizable composition comprises a colorant and a polymerizable monomer. The process P1 may include the step S1 and a subsequent step S2 of polymerizing a polymerizable monomer in the presence of the resultant colored polymer particles of the step S1, and, with adopting such a step S2, the resultant colored polymer particles of the process P1 become core-shell structured. The aqueous medium is generally a water such as an ion exchanged water and a hydrophilic solvent such as alcohols can be added to the aqueous medium if desired. The polymerizable composition may include a lot of kinds of additives such as charge control agents, parting agents, cross-linkable monomers, macromonomers, molecular weight modifiers, lubricants, and dispersion aids, if desired.

(1) Polymerizable Monomer.

In the present invention, the main material of polymerizable monomer should be monovinyl monomer(s). Examples of the monovinyl monomers include: aromatic vinyl monomers such as styrene, vinyl toluene and α-methyl styrene; acrylic acid and its derivatives such as methyl acrylate, ethyl acrylate, propyl acrylate, butyl acrylate, 2-etylhexyl acrylate, cyclohexyl acrylate, isobonyl acrylate, dimethylaminoethyl acrylate and acrylamide; methacrylic acid and its derivatives such as methyl methacrylate, ethyl methacrylate, propyl methacrylate, butyl methacrylate, 2-etylhexyl methacrylate, cyclohexyl methacrylate, isobonyl methacrylate, dimethylaminoethyl methacrylate and methacrylamide; and mono olefin monomers such as ethylene, propylene and butylenes.

The monovinyl monomers may be used alone or in combination thereof. Among the monovinyl monomers as mentioned above, it is preferable to use aromatic vinyl monomers alone, or to use aromatic vinyl monomers in combination with acrylic acid derivatives or methacrylic acid derivatives.

It is desirable to use a cross-linkable monomer together with the monovinyl monomer to improve a hot offset property. The cross-linkable monomer is a monomer which has plural vinyl groups. As such cross-linkable monomers, there are; aromatic divinyl compounds such as divinylbenzene, divinylnaphthalene, and their derivatives, unsaturated carboxylic acid esters with two vinyl groups such as ethylene glycol dimethacrylate, diethylene glycol dimethacrylate, and 1,4-butane-diol diacrylate; compounds with 2 vinyl groups such as N,N-divinylaniline and divinyl ether; compounds with two or more than two vinyl groups such as pentaerythritol triallyl ether and trimethyrolpropane triacrylate; and the like.

The cross-linkable monomer may be used alone or in combination thereof. They may be used in a proportion of generally not larger than 10 parts by weight, preferably 0.01 to 7 parts by weight, more preferably 0.05 to 5 parts by weight, still more preferably 0.1 to 3 parts by weight, per 100 parts by weight of the monovinyl monomer.

Additional use of a macromonomer together with the monovinyl monomer is preferable to balance the shelf stability and the lowering of the fixing temperature of the resultant polymerized toner. The macromonomer is preferably an oligomer or polymer having a polymerizable functional group involving carbon-carbon-double bond at its molecular chain terminal and a number average molecular weight of about 1,000 to 30,000. The using of the macromonomer in the above-mentioned range is preferable since the shelf stability of the toner is improved while fixing property is kept well.

As examples of the polymerizable vinyl functional group involving carbon-carbon-double-bond that the macromonomer may have at its molecular chain terminal, there are an acryloyl group and a methacryloyl group, and preferably the methacryloyl group from the viewpoint of easy copolymerization with the monovinyl monomer.

As the macromonomer used in the present invention, there are: polymers obtained by polymerizing styrene, styrene derivatives, methacrylic esters, acrylic esters, acrylonitrile and methacrylonitrile, where these may be used alone or in combination of two or more thereof; and macromonomers having a polysiloxane structure. Among these macromonomers, hydrophilic macromonomers are particularly preferred, and, in particular, polymers obtained by polymerizing methacrylic esters or acrylic esters alone or in combination thereof are more preferable.

The macromonomer may be used in a proportion of generally 0.01–10 parts, preferably 0.03 to 5 parts and more preferably 0.05 to 1 part by weight per 100 parts by weight of the monovinyl monomer used. If the proportion is in this range, the fixing property of the resultant toner is preferably improved while shelf stability is kept well.

(2) Colorant.

A colorant is used in the present invention, and examples of such colorant include many kinds of pigments and dyes, such as carbon black and titanium white, which are commonly used in the toner area can be used. As a black colorant, there are: carbon blacks; dyes and pigments derived from nigrosine; magnetic particles such as cobalt, nickel, triiron tetroxide, manganese iron oxide, zinc iron oxide and nickel iron oxide; and the like. Among carbon blacks, such a carbon black that has a primary particle diameter of 20 to 40 nm is preferable because the printed image developed using the resultant polymerized toner has a high quality and the safety of working environment is improved. Yellow colorants, magenta colorants, cyan colorants and the like are used for producing a color toner.

As a yellow colorant, there are: condensation azo compounds, iso-indolynone compounds, anthraquinone compounds, azo-metal complexes, methyne compounds and allyl amide compounds; more specifically, C.I. Pigment Yellow 3, 12, 13, 14, 15, 17, 62, 65, 73, 74, 83, 90, 93, 95, 97, 109, 110, 111, 120, 128, 129, 138, 147, 155, 168, 180, 181, and the like; in addition, Naphtol Yellow S, Hansa Yellow G, C.I. Vat Yellow and the like.

As a magenta colorant, there are: condensation azo compounds, diketo-pyrrolo pyrrole compounds, anthraquinone compounds, quinacridone compounds, base dye-lake compounds, naphtol compounds, benzimidazolone compounds, thioindigo compounds and perylene compounds: more specifically, C.I. Pigment Red 2, 3, 5, 6, 7, 23, 48, 48:2, 48:3, 48:4, 57, 57:1, 58, 60, 63, 64, 68, 81, 81:1, 83, 87, 88, 89, 90, 112, 114, 122, 123, 144, 146, 149, 163, 166, 169, 170, 177, 184, 185, 187, 202, 206, 207, 209, 220, 251, 254 and the like; in addition, C.I. Pigment Violet 19 and the like.

As a cyan colorant, there are: phthalocyanine-copper compounds or their delivatives, anthraquinone compounds and base dye-lake compounds; more specifically, C.I. Pigment Blue 1, 2, 3, 6, 7, 15, 15:1, 15:2, 15:3, 15:4, 16, 17, 60, 62, 66 and the like; in addition, phthalocyanine blue, C.I. Vat Blue, C.I. Acid Blue, and the like.

These colorants can be used alone or in combination thereof and in the proportion of ordinarily 0.1 to 50 parts by weight and preferably 1 to 20 parts by weight per 100 parts by weight of the polymerizable monomer used.

(3) Additives.

The polymerizable composition may include a lot of kinds of additives other than polymerizable monomers and colorants.

(3-1) Charge control agents.

In the present invention, the various kinds of charge control agents having positive charging ability or negative charging ability may be used as one of additives to improve the charge properties of the resulting polymerized toner. As the charge control agents, there are: metal complexes of organic compounds having a carboxyl group or a nitrogen-containing group; metallized dyes; nigrosine; charge control resins; and the like. More specifically, there are: charge control agents such as Bontron N-01 (product of Orient Chemical Industries Ltd.). Nigrosine Base EX (product of Orient Chemical Industries Ltd.), Spiron Black TRH (product of Hodogaya Chemical Co., Ltd.), T-77 (product of Hodogaya Chemical Co., Ltd.), Bontron S-34 (product of Orient Chemical Industries Ltd.), Bontron E-81 (product of Orient Chemical Industries Ltd.), Bontron E-84 (product of Orient Chemical Industries Ltd.), Bontron E-89 (product of Orient Chemical Industries Ltd.), Bontron F-21 (product of Orient Chemical Industries Ltd.), COPY CHARGE NX VP434 (product of Clariant GmbH), COPY CHARGE NEG VP2036 (product of Clariant GmbH), LR-147 (product of Japan Carlit Co., Ltd.), COPY BRUE PR (product of Clariant GmbH), and the like; and charge control resins such as quaternary ammonium salt-containing resins, sulfonic group-containing resins and the like. The charge control agent is used in a proportion of generally 0.01 to 10 parts by weight, and preferably 0.03 to 5 parts by weight, per 100 parts by weight of the polymerizable monomer used.

(3 -2) Parting Agents.

In the present invention, a parting agent is preferably used as one of additives in the polymerizable monomer composition to avoid offset of the resulting polymerized toner, or to improve the parting ability of the toner at fixing by a heating roll. As the parting agent, there are: polyolefin waxes such as low molecular weight polyethylene, low molecular weight polypropylene and low molecular weight polybutylene; natural plant waxes such as candelilla, carnauba wax, rice, wood wax, jojoba oil; petroleum waxes such as paraffin, microcrystalline wax and petrolactam, and denaturations thereof; synthesized waxes such as Fischer Tropsch wax and the like; multifunctional ester compounds such as pentaerythritol tetramyristate, pentaerythritol tetrapalmitate, and dipentaerythritol hexamyristate; and the like. These compounds may be used alone or in combination thereof.

Among these as listed here, it is preferable to use the synthesized waxes, polyolefin waxes, petroleum waxes, or multifunctional ester compounds. The parting agent is used in a proportion of generally 0.1 to 50 parts by weight, preferably 0.5 to 20 parts by weight, and more preferably 1 to 10 by parts by weight, per 100 parts by weight of the polymerizable monomer used.

(3—3) Lubricant and Dispersion Aid.

In the present invention, a lubricant or a dispersion aid may preferably be used as one of the additives of the polymerizable monomer composition to improve uniformity of distribution of colorant into the toner. As the lubricant, there are: fatty acids such as oleic acid, stearic acid, and the like; salts of one of the fatty acids and metal, such as Na, K, Ca, Mg, Zn and the like; and the like. Such a lubricant or dispersion aid is generally used in a proportion of about 1/1,000 to 1/1 based on the weight of the colorant used.

(3-4) Molecular Weight Modifier.

In the present invention, a molecular weight modifier is preferably used as one of additives of the polymerizable monomer composition. As the molecular weight modifier, there are: mercaptans such as t-dodecylmercaptan, n-dodecylmercaptan, n-octylmercaptan, and the like; halogenated hydrocarbons such as carbon tetrachloride, carbon tetrabromide and the like; and the like. These molecular weight modifiers is generally contained in the polymerizable monomer composition before the initiation of the polymerization. However, they may be added into the polymerization monomer composition during polymerization reaction. The molecular weight modifier in used in a portion of generally 0.01 to 10 parts by weight, and preferably 0.1 to 5 parts by weight, per 100 parts by weight of the polymerizable monomer.

(4) Other Chemicals (4-1) Polymerization Initiator

The polymerizable monomer composition, generally and preferably, includes, and is subjected to polymerization in the presence of, a polymerization initiator. As the polymerization initiator, there are: persulfates such as potassium persulfate, ammonium persulfate and the like; azo compounds such as 4,4'-azobis(4-cyanovaleric acid), 2,2'-azobis [2-methyl-N-(2-hydroxyethyl) propionamide], 2,2'-azobis (2-amidinopropane)dichloride, 2,2'-azobis(2,4-dimethylvaleronitrile), 2,2'-azobisisobutyronitrile, and the like; peroxides such as di-t-butyl peroxide, dicumyl peroxide, lauroyl peroxide, benzoyl peroxide, t-butyl peroxy-2-ethylhexanoate, t-hexylperoxy-2-ethylhexanoate, t-butyl peroxypivalate, diisopropyl peroxy dicarbonate, di-t-butyl peroxyisophthalate, 1,1',3,3'-tetramethylbutyl peroxy-2-ethylhexanoate, t-butyl peroxy isobutylate, and the like; and the like. Redox initiators composed of combinations of these polymerization initiators with a reducing agent may also be used.

Among these polymerization initiators, oil-soluble polymerization initiators which are soluble to the polymerizable monomer composition are preferred, which oil-soluble polymerization initiators may be used in a combination with water-soluble polymerization initiators. The polymerization initiator is used in a proportion of generally 0.1 to 20 parts by weight, preferably 0.3 to 15 parts by weight, more preferably 0.5 to 10 parts by weight, per 100 parts by weight of the polymerizable monomer used.

The polymerization initiator may be contained in a polymerizable monomer composition in the step of preparing it in advance. In order to avoid premature polymerization, however, it is preferable to add the polymerization initiator, after the pouring the polymerizable monomer composition into an aqueous dispersion medium and forming small droplets of the polymerizable monomer composition, or to the dispersion during polymerization reaction.

(4-2) Dispersion Stabilizer.

A dispersion stabilizer is preferably added to the aqueous dispersion medium before polymerization step S1. Colloid of a hardly water-soluble metallic compound is preferable as a dispersion stabilizer. As the hardly water-soluble metallic compounds there are: sulfates such as barium sulfate, calcium sulfate, and the like; carbonates such as barium carbonate, calcium carbonate, magnesium carbonate, and the like; phosphates such as calcium phosphate and the like; metal oxides such as aluminum oxide, titanium oxide, and the like; metal hydroxides such as aluminum hydroxide, magnesium hydroxide, ferric hydroxide, and the like; and the like. Among these, colloids of hardly water-soluble metal hydroxides are preferable because the particle diameter distributions of the resultant colored polymer particles can be narrowed, and the sharpness of an image developed with the resultant polymerized toner is enhanced.

The colloids of the hardly water-soluble metal hydroxides are not limited by the production process thereof. However, such colloids as obtained with adjusting the pH of an aqueous solutions of water-soluble polyvalent metallic compounds to 7 or higher are preferable; more specifically, such colloids as obtained from the reaction of water-soluble polyvalent metallic compounds and alkali metal hydroxide salts in aqueous medium are more preferable. The colloids of the hardly water-soluble metallic compounds preferably have number particle diameter distribution, D50 (50% cumulative value of number particle diameter distribution) of no larger than 0.5 $\mu$m, and D90 (90% cumulative value of number particle diameter distribution) of no larger than 1 $\mu$m.

The dispersion stabilizer is generally used in a proportion of 0.1 to 20 parts by weight per 100 parts by weight of the polymerizable monomer. If the proportion is too small, sufficient polymerization stability is difficult to achieve and polymerization coagulum is easy to rise. If the proportion is too large on the other hand, the viscosity of the aqueous dispersion medium increases and polymerization stability lowers.

(5) Steps S1 and S2 of Polymerizing.

(5-1) Step S1

A polymerized toner is colored polymer particles where a colorant and additives such as a charge control agent and a parting agent are dispersed in a matrix of a binder resin which is generated polymerizing (step S1) a polymerizable monomer composition. In addition, core-shell structure colored polymer particles may be produced by generating (step S2) a polymer layer (referred as "shell" thereafter) on the surface of the colored polymer particles (referred as "core" thereafter) generated in S1; in this case, the resultant polymerized toner become core-shell structured.

A polymerized toner is produced, for instance, by the following method. The polymerizable monomer, colorant, additives, and the like are mixed with a mixer, and a polymerizable monomer composition is obtained, if necessary, by subjecting the mixture to wet-grinding using a media-type wet-grinding machine (such as bead mill). The polymerization monomer composition is dispersed into an aqueous medium including a dispersion stabilizer; the resultant dispersion is agitated; and uniform droplets (referred as "preliminary droplets", whose volume average particle diameter is about 50–1,000 μm) of the polymerization monomer composition are obtained. A polymerization initiator may be added into the aqueous medium preferably after the sizes of the preliminary droplets become uniform in order to avoid premature polymerization.

After adding a polymerization initiator into the dispersion where the preliminary droplets of the polymerizable monomer composition are dispersed into the aqueous medium, the dispersion is kept agitating with a high-speed-rotating-shearing-type mixer until the droplets become small to the size near to that of the objective polymerized toner. Providing the dispersion including thus obtained fine droplets (referred as "secondary droplets", whose volume average particle diameter is about 1–12 μm) into a reactor, polymerization (referred as "process P1") is carried out at the temperature of generally 5–120° C., and preferably 35–95° C. If the temperature is too low, the control of the polymerization becomes difficult because such a polymerization initiator with a high catalyst activity may be used. If the temperature is too high, and in case that the polymerizable monomer composition includes such a additive as melts at low temperature, such a additive tends to bleed out to the surface of the resultant polymerized toner, and the toner tends to have bad shelf stability.

The volume average diameter and the particle diameter distribution of the secondary droplets of the polymerizable monomer composition have a contribution to the volume average diameter and the particle diameter distribution of the resultant polymerized toner. If the volume average particle diameter of the secondary droplets is too large., the particles of the resultant polymerized toner become too large, and the resolution of the image developed with it tends to fall. If the particle diameter distribution is too broad, variety of fixing temperature becomes large and it causes problems such as fog in an image and filming of toner. Therefore it is desirable to set the particle diameter of the secondary droplets almost equal to that of the objective polymerized toner.

The volume average particle diameter of the secondary droplets of the polymerizable monomer composition is generally 1–12 μm, preferably 2–10 μm, and more preferably 3–8 μm. And, in order to produce a polymerized toner with small particle diameter with which is suitable to develop high quality and fine images, the volume average particle diameter of the secondary droplets should be preferably 2–9 μm, more preferably 3–8 μm, and still more preferably 3–7 μm. The particle diameter distribution (which is described as the ratio of volume average particle diameter to number average particle diameter) of the secondary droplets of the polymerizable monomer composition is generally 1–3, preferably 1–2.5, and more preferably 1–2. In order to make the secondary droplets very fine, such a device is favorable where the dispersion including the polymerizable monomer composition flows through a gap between a high-speed-rotating agitator and a buffer with pores or teeth surrounding the agitator.

One or more than one polymerizable monomers are selected and used from the above-mentioned list. It is preferable to use such a monomer or a combination of monomers which generates a polymer whose glass transition temperature (referred as "Tg") is in the range of generally not higher than 80° C., preferably 40–80° C., more preferably 50–70° C. when it is polymerized alone, in order to lower the fixing temperature of the resultant polymerized toner. In the present invention "Tg" means the value measured with a differential scanning calorimetry. The polymerization reaction in step S1 should be achieved until the conversion ratio (into a polymer) reaches preferably more than 90%, and more preferably more than 95%.

After polymerization (step S1) is processed to the dispersion, colored polymer particles where a colorants and additives disperse in a matrix polymer are generated by the polymerization of the polymerizable monomer. By processing the following processes (P2 and P3) to such obtained colored polymer particles, a polymerized toner is produced, and in such a case, the resultant polymerized toner becomes ordinary type (other than core-shell structured); this is one of the methods which the present invention provides. On the other hand, the obtained colored polymer particles by step S1 can be processed to a subsequent polymerization (step S2) where a polymer layer (referred as "shell") is generated on the surface of the obtained colored polymer particles; then by processing the following processes (P2 and P3) to such obtained colored polymer particles by step S2, a polymerized toner is produced, and in such a case, the resultant polymerized toner becomes a core-shell structure toner, which is a capsule toner with a core-shell structure; this is the other method which the present invention provides. Thus obtained core-shell structure toner is intend to have a better shelf stability (an improved blocking property), an improved fixing ability at lower temperature and an improved melting property at fixing.

(5-2) Step S2.

In order to generate a core-shell structure, in step S2 in process P1, another polymerizable monomer for the shell is polymerized in the presence of the obtained colored polymer particles (referred as "core particles" in this case) by step S1; and a polymer layer (shell) is generated on the surface of the core particles. If a polymerizable monomer which generate a polymer with higher Tg than that of the matrix polymer of the core particles is used, the shelf stability of the resultant polymerized toner can be improved. On the other hand, if Tg of the matrix polymer of the core particles is set lower, some properties of the resultant polymerized toner are improved: fixing temperature can be lowered and melting property can be improved. Therefore, setting the two Tg's to the appropriate values and generating core-shell structure colored polymer particles in process P1, an excellent polymerized toner is produced which is suitable for high-speed coping or printing, full-color coping or printing, and use for OHP (over head projector).

One or more than one polymerizable monomers are selected and used from the above-mentioned list as a polymerizable monomer for the core and a polymerizable monomer for the shell, respectively. The polymerizable monomer for the core and that for the shell are preferably different from each other. The portion ratio of the polymerizable monomer for the core to the polymerizable monomer for the shell is generally 40/60–99.9/0.1, preferably 60/40–99.7/0.3, and more preferably 80/20–99.5/0.5, by weight. If the portion of that for the shell is too small, the improvement of the shelf stability of the resultant polymerized toner is little; if the portion is too large, the improvement in lowering the fixing temperature is little.

Tg of a polymer which generated by polymerizing the polymerizable monomer for the shell is generally higher than 50° C. and not higher than 120° C., preferably higher than 60° C. and not higher than 110° C., and more preferably higher than 80° C. and not higher than 105° C. The difference between Tg of a polymer which generated by polymerizing the polymerizable monomer for the shell and Tg of a polymer which generated by polymerizing the polymerizable monomer for the core is preferably not less than 10 degrees (in Celsius' temperature scale, hereinafter), more preferably not less than 20 degrees, and still more preferably not less than 30 degrees. In many cases, in order to improve the balance of lowering fixing temperature and improving shelf stability of the resultant polymerized toner, it is preferable to select the polymerizable monomer for the core which generate a polymer by polymerizing whose Tg is generally not higher than 60° C., preferably 40–60° C.; on the other hand, it is preferable to select the polymerizable monomer for the shell, such as styrene and methyl methacrylate, which generates a polymer by polymerizing whose Tg is generally higher than 80° C.; and each monomer is used either alone or in combination thereof, respectively.

It is preferable to provide the polymerizable monomer for the shell as droplets whose volume average particle diameter is smaller than that of the core particles into the polymerizing dispersion (hereinafter dispersion under or for polymerizing reaction is referred as "polymerizing dispersion", if appropriate). If the droplets of the polymerizable monomer for the shell are too large rather than the core particles, it is difficult to generate the polymer layer (shell) uniformly on the surface of the core particles. In order to obtain small particles of the polymerizable monomer for the shell, a mixture of the polymerizable monomer for the shell and the aqueous medium may be treated (referred as "finely dispersing treatment" thereafter) with a mixer such as a ultrasonic emulsionizer; where the monomer is finely dispersed into the aqueous medium, and then the obtained emulsion may be provided into the polymerizing dispersion.

If the polymerizable monomer for the shell (for instance, such as methyl methacrylate) is rather water-soluble and has a solubility of not smaller than 0.1 weight % to water at 20° C., the above-mentioned finely dispersing treatment is not always necessary because the monomer can easily arrive to the surface of the core particles, however the treatment is desirable to generate a more uniform shell. If the polymerizable monomer for the shell (for instance, such as styrene) has a solubility of smaller than 0.1 weight % in water at 20° C., the above-mentioned finely dispersing treatment or adding a organic solvent (such as alcohols) having a solubility of not smaller than 5 weight % in water at 20° C. to the polymerizing dispersion is desirable in order to make it easy for the monomer to arrive to the surface of the core particles.

A charge control agent or agents are desirably added to the polymerizable monomer for the shell. Such a charge control agent can be selected and used from the above-mentioned list. It is used in the portion of generally 0.01–10 parts by weight, and preferably 0.1–5 parts by weight, per 100 parts by weight of the polymerizable monomer for the shell.

In the step S2, the polymerizable monomer for the shell or aqueous dispersion thereof is provided in a lump, or continuously or intermittently for a while, into the dispersion including core particles. It is desirable to add a water-soluble polymerization initiator to the polymerizing dispersion, at the time or sequentially after the polymerization monomer for the shell is provided, in order to generate shell efficiently. This is because the water-soluble polymerization initiator arrives near to the outer surface of the core particles where the polymerization monomer for the shell exists, and the polymer layer (shell) is easily generated on the surface of the core particles, if the water-soluble polymerization initiator is added.

As the water-soluble polymerization initiator, there are: persulfates such as potassium persulfate, ammonium persulfate and the like; azo compounds such as 2,2'-azobis[2-methyl-N-(2-hydroxyethyl) propionamide], 2,2'-azobis{2-methyl-N-[1,1 -bis(hydroxymethyl) ethyl]propionamide}; and the like. The water-soluble polymerization initiator is used in the portion of generally 0.1–50 parts by weight, and preferably 1–20 parts by weight, per 100 parts by weight of the polymerizable monomer for the shell. The polymerization reaction in step S2 should be achieved until the conversion ratio (into a polymer) reaches preferably more than 90%, and more preferably more than 95%.

The thickness of the shell is generally 0.001–1.0 μm, preferably 0.003–0.5 μm, and more preferably 0.005–0.2 μm. If the shell is too thick, the resultant polymerized toner has lowered fixability; if the shell is too thin, the resultant polymerized toner has deteriorated shelf stability. The particle diameters of the polymerized toner and thickness of the shell can be obtained by measuring directly the particle diameters of the particles selected at random or the thickness of the shell, with using photographs thereof, if they are observable with an electron microscope. The particle diameters of the polymerized toner and thickness of the shell can be obtained by calculating with the values of the particle diameters of the core particles and the amount of the polymerizable monomer used, if core and shell are difficult to observe with an electron microscope.

Process P2: Reducing the Remaining Polymerizable Monomer from the Colored Polymer Particles.

In the process P1, the dispersion of the core-shell structured, or ordinary, colored polymer particles is obtained. Then the remaining polymerizable monomer is reduced from the colored polymer particles in the next process P2, wherein the dispersion is treated by stripping. In the present invention, the dispersion is treated by stripping in the presence of a specific antifoaming agent.

In the present invention, the antifoaming agent is selected from a group consisting of fats-and-oils antifoaming agents, mineral oil antifoaming agents, polyether antifoaming agents, polyalkyleneglycol nonionic surfactants, emulsions consisting of fats-and-oils and polyalkyleneglycol nonionic surfactants, and emulsions consisting of mineral oils and polyalkyleneglycol antifoaming agents. Among these, mineral oil antifoaming agents, polyether antifoaming agents, polyalkyleneglycol nonionic surfactants, and emulsions consisting of fats-and-oils and polyalkyleneglycol nonionic surfactants are preferable, because they have a high efficiency of antifoaming and the resultant polymerized toner has improved properties.

These antifoaming agents appear on the market as names of "defoaming agents" or "antifoaming agents." Mineral oil antifoaming agents are denaturated hydrocarbon oils derived from mineral oil; and as Such antifoaming agents there are "antifoaming agent DF714S" (product of Japan PMC Co., Ltd.) and the like on the market. Polyalkyleneglycol nonionic surfactants include polyethyleneglycol nonionic surfactants, polyoxyethylene-polyoxypropylene-block-copolymer nonionic surfactants, and the like; and as such antifoaming agents there are "SN Defoamer 180" (product of San Nopco Ltd.; one of polyoxyalkylene nonionic surfactants) and the like on the market. Emulsions consisting of fats-and-oils and polyalkyleneglycol nonionic surfactants are emulsions where fats-and-oils are emulsionized with polyalkyleneglycol nonionic surfactants; and as such antifoaming agents there are "SN Defoamer 1407K" (product of San Nopco Ltd.; one of emulsions consisting of fats-and-oils and polyethyleneglycol nonionic surfactants) and the like on the market. As polyether antifoaming agents there are: ordinary polyether antifoaming agents such as "Adeka Nol LG-51", "Adeka Nol LG-109" (product of Asahi deika Co., Ltd.) and the like; special polyether antifoaming agents such as "IP Defoamer U-510" (product of Ipposha Oil Industries Co., Ltd.); and the like on the market.

The solid content of the dispersion to be treated by stripping is in the range of preferably 5–45 weight %, more preferably 10–40 weight %, and still more preferably 15–35 weight %. If the dispersion obtained from process P1 has a higher solid content than the above-mentioned range, it is desirable to add water such as distilled water to the dispersion before treatment by stripping to control the solid content within the desirable range.

In the present invention, the antifoaming agent is used in a portion of 0.01–1 parts by weight, and more preferably 0.05–0.5 parts by weight, per 100 parts by weight of colored polymer particles included. If the portion is too small, it is difficult to get sufficient antifoaming efficiency; if too large, the antifoaming efficiency is saturated and the resultant polymerized toner has a larger likelihood of deteriorated properties.

As treating maimers by stripping there are: bubbling where a gas such as inert gases (such as nitrogen, argon and helium), water vapor, carbon dioxide, and the like, is blown into the dispersion; stripping under reduced pressure where the dispersion is treated by stripping and heating under reduced pressure; flushing; and the like. Among these manners, bubbling and stripping under reduced pressure are preferable. Temperature of the blowing gas is preferably not higher than 100° C. in order to keep the colored polymer particle away from aggregating. Inert gases such as nitrogen and the like are preferable as the blowing gas. Stripping under reduced pressure with blowing a gas into the dispersion is also available and preferable.

Heating the dispersion during treatment by stripping is desirable because volatile materials, such as the remaining monomer, can vaporize more easily and reducing efficiency of such volatile materials increases. The temperature of the dispersion during treatment by stripping is in a range preferably not lower than Tg of the polymer making up the colored polymer particles and lower than 100° C., more preferably not lower than the Tg and not higher than 95° C., and still more preferably not lower than the Tg and not higher than 90° C. In case that the polymer making up the colored polymer particles has more than one Tg's, the above-mentioned Tg means the lowest Tg. During treatment by stripping, the temperature of the dispersion should be preferably in the above-mentioned range and kept nearly constant; it is desirable to control heating conditions and the like.

Treatment by stripping is carried out preferably with an evaporating tank (an evaporating vessel). To achieve heating of the dispersion, such an evaporating tank accompanied with a jacket to circulate a heating medium, or one with a heat exchanging device in it or connected thereto outside, or the like, is preferable. Heating can be achieved by blowing a heated gas into the dispersion. If the temperature of the dispersion is too low, the evaporating of the dispersion becomes insufficient during treatment by stripping, the remaining monomer moves slowly in the colored polymer particles, and the reducing rate of the remaining monomer lowers. If the temperature of the dispersion is too high, the dispersing stability of the colored polymer particles deteriorates, the possibility of aggregation of the colored polymer particles becomes high during the treatment, and scale adherent to inner wall of the evaporating tank or agitator tends to increase.

The pressure inside the evaporating tank should be set adequately for each actual manner adopted for treatment by stripping, and is generally selected from the range of 5–105 kPa. Choosing the bubbling as the treating manner by stripping, the pressure inside the evaporating tank is preferably in the range of 70–105 kPa. Choosing the stripping under reduced pressure, or the stripping under reduced pressure with blowing a gas, or the like, it is desirable to control the pressure inside the evaporating tank into the range of generally 5–105 kPa, preferably 10–60 kPa, and more preferably 20–50 kPa.

Time period for treatment by stripping should be variable according to the size of the system, the rate of treating, the treating manner choosed, the desired level of the content of the remaining monomer, and the like; and it is generally in the range of 0.5–50 hours, preferably 1–30 hours, and more preferably 3–20 hours.

It is desirable to place an agitator inside the evaporating tank and to achieve the treatment by stripping with agitating the dispersion. Such an agitator is not limited and is desirably accompanied with an agitating blade or blades: wide puddle blades, wide graded blades, Bullmargin blades, full zone blades, wall wetter blades, and the like. Agitator used can be placed as a part of blade accompanied therewith is outstanding over the surface of the dispersion, as is disclosed in Japanese laid open patent application 2001-117,272.

With treatment by stripping, a part of the aqueous medium is reduced from the dispersion, the remaining monomer is reduced from the dispersion, the remaining monomer is reduced from the colored polymer particles, and other volatile materials are reduced from the dispersion. Thus with treatment by stripping, the dispersion in the evaporating tank gets concentrated, and, if desirable, supplemental aqueous medium may be added to the dispersion. However, according to the present invention, the treatment by stripping can be achieved efficiently without adding supplemental aqueous medium. The resultant collected monomer or aqueous medium can be reused.

treating device by stripping which can be used in the present invention. An agitating device accompanied with blades is placed to an evaporating tank. A jacket is placed at the outer wall of the evaporating tank to circulate a heating medium therewith in order to control the temperature of inside of the evaporating tank to a desired temperature. A gas introducing tube is placed in order to introduce a gas such as nitrogen therethrough into the evaporating tank with a blower from a gas source.

After providing the dispersion into the evaporating tank and controlling the temperature of it to the desired temperature, the gas is blown into the evaporating tank with the blower through the orifice of the gas introducing tube. A part of aqueous medium composing the dispersion, the remaining monomer and other volatile materials are introduced to a condensing device then to a condensate tank through gas line. The resultant liquid components, such as water, from condensation, are collected and taken out The resultant gas components from condensation are introduced into a volatile material reducing device through gas line. The volatile material reducing device is, for instance, an absorbing column packed with active carbon, or a bubbling device containing cold water, where the volatile materials such as the remaining monomer are reduced from the gas components from condensation. The obtained gas components such as nitrogen are recycled and can be reused through a gas circulating line with using the blower.

It is desirable to control the flow of the gas, such as nitrogen, in the range of preferably 0.05–2 $m^3$/hr·kg, and more preferably 0.1–1 $m^3$/hr·kg in order to lower a foaming of the dispersion in the evaporating tank. In case of adopting the mere stripping under reduced pressure without blowing a gas, the blower is not used, and the dispersion is heated and evaporated under reduced pressure inside of the evaporating tank.

According to the present invention, the treatment by stripping can be processed stably because foaming at the surface of the dispersion, the interface between gas phase and liquid phase, sufficiently lowers. According to the present invention, the colored polymer particles (the polymerized toner) containing the remaining monomer of generally lower than 100 ppm, preferably lower than 50 ppm, and more preferably lower than 30 ppm, can be produced.

In the present invention, specific antifoaming agents are used; they do not poorly influence the charging properties of the resultant toner; and the resultant polymerized toner has a high charge amount. The polymerized toner has a remarkably low likelihood of causing a fog, and can provide a high and non-variable printing density.

Process P3: Removing the Colored Polymer Particles.

After the treatment by stripping in process P2, the colored polymer particles are removed from the dispersion. Removal process of the colored polymer particles is processed according to a general process and comprises an extraction step of aqueous medium, a rinse step, a filtration step, a drying step, generally in this order, and then the dry colored polymer particles are thereby removed. A step such as washing with an acid or an alkali may be added before the extraction step of aqueous medium in order to make the dispersion stabilizer used soluble and remove it depending on the type of dispersion stabilizer.

The volume average particle diameter of the polymerized toner (ordinary or core-shell structured) produced by the method of the present invention is generally 1–12 $\mu$m, preferably 2–11 $\mu$m, and more preferably 3–10 $\mu$m. And, in order to produce a polymerized toner with which is suitable to develop high quality and fine images, the volume average particle diameter of the polymerized toner should be preferably 2–9 $\mu$m, and more preferably 3–8 $\mu$m.

The particle diameter distribution (described as Dv/Dp; Dv is volume average particle diameter; Dp is number average particle diameter) of the polymerized toner is generally not larger than 1.7, preferably not larger than 1.5, and more preferably not larger than 1.3. If the particle diameter distribution is too large, the portion of rather large polymerized toner particles becomes large and the resolution of images developed therewith tends to lower.

The polymerized toner particles should be substantially spherical and has the sphericity (described as dl/ds; dl is the length of long axis; ds is the length of short axis) of preferably 1–1.3, more preferably 1–1.2. If the substantially spherical toner is used as a non-magnetized-one-component developer, the transcription efficiency is improved.

The polymerized toner may be used as one of various kinds of developers (toners), and is preferably used as a non-magnetized-one-component developer. In case of use as a non-magnetized-one-component developer, an external additive should be added and mixed with the polymerized toner. Examples of external additives include inorganic particles and organic resin particles, which act as fluidizing agents or abrasives.

As such inorganic particles there are silicon dioxide (silica), aluminum oxide (alumina), titanium oxide, zinc oxide, tin oxide, barium titanate, strontium titanate, and the like. As such organic resin particles there are particles of, poly-methacrylic ester, poly-acrylic ester, styrene-methacrylic ester copolymers, styrene-acrylic ester copolymers, core-shell structure particles in which a core is comprising a polystyrene or the like and a shell is comprising of a poly-methacrylic ester or the like; for example.

Among these, the inorganic particles are preferable; silicon dioxide particles are more preferable. The surfaces of these particles can be subjected to a hydrophobicitizing treatment, and hydrophobicitizing silicon dioxide particles are still more preferable. External additives can be used alone or in combination of more than one thereof. In case of combination use, it is preferable to combine large-sized inorganic particles with small-sized inorganic particles, or to combine inorganic particles with organic resin particles. The amount of the external additives used has no particular limitation, and is generally in the portion of 0.1–6 parts by weight per 100 parts by weight of the polymerized toner. The external additives are combined with and adhere to the polymerized toner particles. In order to make the external additives adherent to the polymerized toner particles, in general, the external additive and the polymerized toner particles are provided into a mixer such as a Henschel mixer, then mixed and stirred together.

EXAMPLES

The present invention will be described in detail using the examples and the comparative examples. However, the present invention should not be construed to be limited into the examples. Unless noted otherwise, "parts" and "%" in the explanation of the following examples are based on the weight. The examples and comparative examples are evaluated by the following tests.

(1) Evaluation of the Treating Process by Stripping (P2).

(1—1) Evaluation of Foaming at the Dispersion Surface.

The liquid surface of the dispersion during treatment by stripping was visually observed. Foaming at the liquid surface was evaluated and rated with the following ranks:

Good: a stable state, where no or little amount of scattered foam stayed or a thin layer of foam was formed on the liquid surface;

Medium: an unstable state, where relentless foam stayed or a such a layer of foam was formed with its tip hovering under level of an exhausting nozzle which was placed upper end of the evaporating tank; or Bad: so unstable state that the treatment could not be processed and operated continuously, where a such a layer of foam was formed with its tip reaching the exhausting nozzle.

(1-2) Quantitative Analysis of the Remaining Monomer.

(1-2-1) The Remaining Monomer Content Before the Treating Process P2 by Stripping.

About 3 g of colored polymer particles was sampled before the treating process by stripping and then it was weighed precisely to the order of mg. The colored polymer particles and 27 g of N,N-dimethylformamide were mixed together and the mixture was stirred for 15 minutes; 13 g of methanol was added to the mixture and then the resultant mixture (solution) was stirred for 10 minutes. So obtained solution was laid still for a while and the insoluble components thereof were precipitated out. 2 $\mu$l of liquid was sampled from the top clear layer of the solution and was analyzed quantitatively about its content of the remaining monomer with injecting into a gas chromatography apparatus.

The conditions of the gas chromatography were the followings: column used is TC-WAX (0.25 mm diameter and 30 m length); temperature of column was 80° C.; temperature at injecting was 200° C.; temperature of FID detector was 200° C.; and the solution of each monomer used, N,N-di-methyl-formamide, and methanol, was used as each standard sample to quantify.

Since the colored polymer particles before the treatment by stripping is wet, it is necessary to calculate the content of the remaining monomer in the colored polymer particles as a ratio to the solid components of the wet colored polymer particles. That is to say, the content of the remaining monomer is calculated by multiplying obtained solid content to the obtained content of the remaining monomer in the wet colored polymer particles. The solid content of the wet colored polymer particles before the treatment by stripping was obtained as the followings:

i The dispersion of the colored polymer particles before the treatment by stripping was sampled;

ii Wet colored polymer particles were obtained by extracting aqueous medium from and filtering the sample solution;

iii The obtained wet colored polymer particles was weighed precisely to the order of mg;

iv The wet colored polymer particles was dried for an hour at the temperature of 105° C. and then weighed precisely; and v The solid content of the wet colored polymer particles was calculated using the weight deference between before drying and after drying.

(1-2-2) The Remaining Monomer Content After the Treating Process P2 by Stripping.

About 3 g of colored polymer particles was sampled after the treating process by stripping and then was weighed precisely to the order of mg. Then the content of the remaining monomer was analyzed and calculated in the same manner as in paragraph (1-2-1) except that this colored polymer particles were used. The content of the remaining monomer was also analyzed and calculated in the same manner as in paragraph (1-2-1) for the colored polymer particles after extraction step of aqueous medium, a rinse step, a filtration step, and a drying step; in this case, the content was analyzed and calculated directly as a ratio to the (dry) colored polymer particles (as is, without procedures i–v in paragraph (1-2-1)) since they were already dry.

(1-2-3) Reducing Rate of the Remaining Monomer.

A reducing rate of the remaining monomer was analyzed and obtained as a portion of the remaining monomer per unit time by comparing to the monomer content before the treatment by stripping. This analysis was achieved as the followings:

The dispersion was sampled every one hour during the treatment by stripping, and then the remaining monomer content was analyzed and obtained in the same manner as in paragraph (1-2-1);

The obtained data were plotted on a semi-logarithm plane, where x-axis was for treating time, and y-axis was for remaining monomer content and in logarithm scale;

Using best fitting manner, the most approximate equation was obtained in exponential form as $y=a\cdot\exp(-bx)$; and A reducing rate of remaining monomer (Rs, in unit of %/hr) was obtained using thus obtained value of b and the equation $Rs=100\cdot(1-\exp(-b))$.

(2) Properties as a Toner (2-1) Volume Average Particle Diameter and Particle Diameter Distribution.

A volume average particle diameter (dv) and a particle diameter distribution, which is a ratio (dv/dp) of dv and number average particle diameter (dp), of the colored polymer particles (that is to say a polymerized toner), were measured by using MULTISIZER (manufactured by Beckman Coulter Inc.). The measurement using MULTISIZER was carried out under the following conditions: the aperture diameter was set to 100 μm; Isotone II was used as a medium; the concentration was set to 10%; and the number of particles subjected to measurement was 100,000.

(2—2) Charge Amount.

A commercially available non-magnetic-one-component developing type printer (printing speed: 24 prints per minute) was used. A toner (a developer) to be tested and sheets are set into the printer. The printer was laid still over a day and a night at a N/N condition (temperature: 23° C.; relative humidity: 50% RH), and then charge amount of the toner was tested and obtained as the followings; some sheets were printed using the toner; the developer (the toner) on the developing roll was vacuumed with a vacuuming-type charge amount measuring apparatus at the beginning of the printing; charge (Q) and vacuumed weight (M) were measured; and charge amount per unit weight (Q/M, unit is μC/g) was obtained.

(3) Printing Properties.

(3-1) Printing Density.

The same printer as in the test (2—2) was used. After the printer was prepared in the same manner with in the test (2—2), the test was started to continue printing at a concentration of 5% (which means 5 area % of surface of printed sheets are covered with toner), which was interrupted, once every 100 sheets of paper, by printing at a concentration of 100% (which is called a "solid" printing). The solid printed sheets were intended to evaluate a printing density. The printing densities were measured using a Macbeth reflection densitometer at the tip of the solid area and at the opposite top of the solid area of the sheets.

(3-2) Fog.

The same printer as in the test (2—2) was used. After the printer was prepared in the same manner with in the test (2—2), the test began with continuing printing at a concentration of 0% (which is called a "white" printing). The printing at a concentration of 0% was intended to evaluate the generation of a fog. After the white printing, the toner on the photosensitive member was stripped off and collected by sticking an adhesive tape (Scotch Mending Tape 810-3-18, a product of Sumitomo 3M Limited) on the member. Then the adhesive tape was pealed to stick it on a new sheet of paper for measuring whiteness, that is, "whiteness (B)," using a whiteness meter (manufactured by Nippon Denshoku Industries Co., Ltd.). As a control, an adhesive tape alone was attached on another new sheet of paper to measure whiteness, that is "whiteness (A)." Fog value was calculated and described as $$\text{Fog}=\text{whiteness }(B)-\text{whiteness }(A).$$

Example 1

(1) Preparation of Polymerizable Monomer Composition (for the Core)

A polymerizable monomer mixture (Tg of the resulting copolymer=55° C.) for the core (or for ordinary polymerized toner) composed of 80.5 parts of styrene and 19.5 parts of n-butyl acrylate, 0.3 parts of a polymethacrylic ester macromonomer (trade name is "AA6"; Tg=94° C.; product of Toagosei Chemical Industry Co., Ltd.), 0.5 parts of divinylbenzene. 1.2 parts of t-dodecylmercaptan, 7 parts of carbon black (trade name is "#25B"; product of Mitsubishi Kagaku Co., Ltd.). 1 part of a charge control agent (trade name is "Spiron Black TRH"; product of Hodogaya Chemical Co., Ltd.), and 2 parts of a parting agent (Fischer-Tropsch wax: trade name is "Paraflint Spray30"; product of Sasol; peak endothermic temperature is 100° C.) were subjected to wet grinding by means of a media-type wet-grinding machine to obtain a polymerizable monomer composition for the core (or for ordinary polymerized toner).

(2) Preparation of Aqueous Dispersion Medium

An aqueous solution of 6.2 parts of sodium hydroxide (alkali metal hydroxide) dissolved in 50 parts of ion-exchanged water was gradually added to an aqueous solution of 10.2 parts of magnesium chloride (water-soluble polyvalent metallic salt) dissolved in 250 parts of ion-exchanged water under stirring to prepare an aqueous dispersion medium containing magnesium hydroxide colloid (colloid of hardly water-soluble metal hydroxide). The particle diameter distribution of the colloid formed was measured by means of a microtrack particle diameter distribution measuring device (manufactured by Nikkiso Co., Ltd.) and found to be 0.35 μm in terms of D50 (50% cumulative value of number particle diameter distribution) and 0.84 μm in terms of D90 (90% cumulative value of number particle diameter distribution). The measurement by means of the microtrack particle diameter distribution measuring device was performed under the following conditions:measuring range: 0.12 to 704 μm; measuring time: 30 seconds; and medium: ion-exchanged water.

(3) Preparation of Polymerizable Monomer for the Shell

Three parts of methyl methacrylate (Tg of the resulting polymer=105° C.) and 100 parts of water were subjected to a finely dispersing treatment by an ultrasonic emulsifier, and an aqueous dispersion of a polymerizable monomer for the shell was obtained. The particle diameter of droplets of the polymerizable monomer for the shell was found to be 1.6 μM of D90 by measurement using the microtrack particle diameter distribution measuring device, which measurement was achieved with adding the droplets of the monomer at a concentration of 3% to an aqueous solution of sodium hexametaphosphate (concentration: 1%).

(4) Generating Droplets

The polymerizable monomer composition (for the core) obtained in the step (1) was poured into the colloidal dispersion medium of magnesium hydroxide obtained in the step (2), and the resultant mixture was stirred until droplets became stable. Six parts of t-butyl peroxy-2-ethylhexanoate (trade name is "Perbutyl O"; product of NOF Corporation) was added as a polymerization initiator to the mixture, and then the resultant dispersion was stirred under high shearing force by means of an Ebara Milder (manufactured by Ebara Corporation) to generate droplets of the polymerizable monomer composition. Thus the aqueous dispersion including the droplets of the polymerizable monomer composition for the core was obtained.

(5) Process P1: Producing a Dispersion of Colored Polymer Particles.

(5-1) Step S1.

The aqueous dispersion including the droplets of the polymerizable monomer composition (obtained in the step (4)) was provided into a reactor equipped with an agitating blade. The dispersion was heated up to 85° C. to initiate a polymerization reaction. The reaction in S1 was achieved until the conversion ratio (into a polymer) reached almost 100%.

(5-2) Step S2.

A mixture of: the aqueous dispersion of the polymerizable monomer for the shell (obtained in the step (3)); and a solution of 0.3 parts of 2,2'-azobis[2-methyl-N-(2-hydroxyethyl) propionamide] (trade name is "VA-086"; product of Wako Pure Chemical Industries, Ltd.) as a water-soluble initiator dissolved into 65 parts of distilled water; was provided to the reactor after (5-1). After the polymerization reaction was continued for 4 hours, the reaction was stopped by cooling down to obtain the dispersion including the core-shell structure colored polymer particles (referred as "dispersion of colored polymer particles" hereinafter). The reaction in S2 was achieved until the conversion ratio (into a polymer) reached almost 100%. The solid content of this dispersion of colored polymer particles was 27%. Then the remaining monomer content in the colored polymer particles (before the treating process P2 by stripping) was measured. The result is shown in Table 1. Further to it, the species of the remaining monomer detected throughout all of the experiments (including examples and comparative examples) was only styrene.

(6) Process P2:the Treatment by Stripping.

Treating device was used to treat the dispersion of colored polymer particles (obtained in (5)) by stripping. The dispersion of colored polymer particles was diluted to a solid content of 20% with ion-exchanged water and provided into an evaporating tank. Then 0.1 parts of antifoaming agent "SN Defoamer 1407K" (product of San Nopco Ltd.; one of emulsions consisting of fats-and-oils and polyethyleneglycol nonionic surfactants) was provided into the evaporating tank. The gas phase inside the evaporating tank was changed to nitrogen gas as nitrogen gas was blown into tank. Then the colored polymer particles dispersion was heated up to 80° C. with agitating using the agitating blades. The blower was turned on, and the colored polymer particles dispersion was treated by stripping and the remaining monomer was reduced with blowing nitrogen gas into the dispersion from the gas introducing tube (orifice of the tube was straight tube shaped), where the flow rate of the nitrogen gas was controlled to 0.6 $m^3$/hr·kg.

The nitrogen gas used for treatment by stripping was introduced through the gas line, to the condensing device, then to the condensate tank. The resultant nitrogen gas from condensation was introduced into the volatile material reducing device (an absorbing tower packed with active carbon), where volatile materials such as the remaining monomer were reduced from the nitrogen gas. The obtained nitrogen gas was recycled and reused, through the gas circulating line, into the evaporating tank through the gas introducing tube, with using the blower.

The treatment by stripping was achieved for 6 hours under the following conditions: the temperature of the dispersion of colored polymer particles was about 80° C. throughout the treating; the pressure inside the evaporating tank was 101 kPa; and flow rate of the nitrogen gas was 0.6 $m^3$/hr·kg. During the treatment, the dispersion of colored polymer particles was sampled every one hour, and the remaining monomer in the colored polymer particles was quantitatively analyzed. After the treatment for 6 hours, the dispersion was cooled down to 25° C.

(7) Process P3:Removing the Colored Polymer Particles.

The colored polymer particles dispersion obtained by process (6) was washed with an acid in such manner that sulfuric acid was added to the dispersion with agitating and the dispersion was still agitated for 10 minutes at temperature of 25° C., where pH of the dispersion was controlled to under 4.5. Solid components were filtrated out and separated from the obtained dispersion of colored polymer particles by: water extraction by meaning of a continuous belt filter (trade name is "Eagle Filter"; manufactured by Sumitomo Heavy Industries, Ltd.): and rinsing. The obtained solid components was dried with a dryer for 10 hours at temperature of 45° C. to get dry colored polymer particles (namely, core-shell structure colored polymer particles or a core-shell structure polymerized toner), which had 7.5 μm of volume average particle diameter (Dv) and 1.19 of particle diameter distribution (Dv/Dp). The remaining monomer in the dry colored polymer particles was quantitatively analyzed.

(8) Process of Producing a Non-Magnetized-One-Component Developer.

One hundred parts of thus obtained dry colored polymer particles and 0.8 parts of hydrophobicitized silicon dioxide particles (brand name is "RX200"; product of Nippon Aerosil Co., Ltd.; volume average particle diameter is 14 nm) were mixed with a Henschel mixer to obtain a non-magnetized-one-component developer for developing electro static images (a toner for lectrophotography use). The printing properties of the obtained toner were evaluated. The results are shown in Table 1.

Example 2

A toner for an electrophotography use was produced in the same manner as in Example 1 (steps (1) through (8)) except that a mineral oil antifoaming agent "DF714S" (one of denaturated hydrocarbon oils derived from mineral oil; product of Japan PMC Co., Ltd.) was used in spite of the antifoaming agent "SN Defoamer 1407K" in step (6). The results are shown in Table 1.

Example 3

A toner for an electrophotography use was produced in the same manner as in Example 1 (steps (1) through (8)) except that an antifoaming agent "SN Defoamer 180" (product of San Nopco Ltd., one of polyoxyalkylene nonionic surfactants) was used in spite of the anti foaming agent "SN Defoamer 1407K" in step (6). The results are shown in Table 1.

Example 4

A toner for an electrophotography use was produced in the same manner as in Example 1 (steps (1) through (8)) except: that the nitrogen gas was not blown into the colored polymer particles dispersion; the pressure in the evaporating tank 1 was reduced to 20 kPa; and the treatment time by stripping was changed to 10 hours from 6 hours; in step (6). The results are shown in Table 1.

Comparative Example 1

Steps (1) through step (6) were processed in the same maimer as in Example 4 except that the antifoaming agent "SN Defoamer 1407K" was not used in step (6). In step (6), the foaming at the liquid surface in the evaporating tank was so terrible that the following procedures were cancelled. The results are shown in Table 1.

Comparative Example 2

A toner for an electrophotography use was produced in the same manner as in Example 1 (steps (1) through (8)) except that a silicone oil antifoaming agent "SM515" (product of Dow Corning Toray Silicone Co., Ltd.; one of silicone oils) was used in spite of the antifoaming agent "SN Defoamer 1407K" in step (6). The results are shown in Table 1.

| | Ex. 1 | Ex. 2 | Ex. 3 | Ex. 4 | Com. Ex. 1 | Com. Ex. 2 |
|---|---|---|---|---|---|---|
| Conditions of step (6): process P2 | | | | | | |
| Temp. of the dispersion (° C.) | 80 | 80 | 80 | 80 | 80 | 80 |
| Pressure inside the evaporating tank (kPa) | 101 | 101 | 101 | 20 | 20 | 101 |
| Blowing gas used | nitrogen | nitrogen | nitrogen | N.A. | N.A. | nitrogen |
| Treatment time (hrs) | 6 | 6 | 6 | 10 | (Cancelled) | 6 |
| Flow rate of blowing gas ($m^3$/hr · kg) | 0.6 | 0.6 | 0.6 | N.A. | N.A. | 0.6 |
| Antifoaming agent used | emulsion consisting of fats-and-oils and polyethylene-glycol nonionic surfactants | mineral oil anti-foaming agent | polyoxy-alkylene nonionic surfactant | emulsion consisting of fats-and-oils and polyethylene-glycol nonionic surfactants | N.A. | silicone oil antifoaming agent |
| Evaluation of step (6): Process P2 | | | | | | |
| Foaming at the liquid surface | good | good | good | good | bad | good |
| Content of the remaining monomer | | | | | | |
| Before stripping | 635 | 635 | 635 | 635 | 635 | 635 |
| After stripping and drying | 11.8 | 13.4 | 12.7 | 15.1 | N.A. | 13.8 |
| Reducing rate of the remaining monomer (%/hr) | 48.5 | 47.4 | 47.9 | 31.2 | N.A. | 47.2 |
| Properties of the toner | | | | | | |
| Charge amount (μC/g) | 30.2 | 29.8 | 34.3 | 31.5 | N.A. | 19.6 |
| Fog | 0.3 | 0.2 | 0.3 | 0.1 | N.A. | 5.4 |
| Printing density | | | | | | |
| at the top | 1.45 | 1.44 | 1.46 | 1.43 | N.A. | 1.41 |
| at the opposite top | 1.45 | 1.43 | 1.15 | 1.44 | N.A. | 0.95 |

As remarkably shown in Table 1, the treating process by stripping where antifoaming agent was not used (Comparative example 1) is inferior to such process as in Example 4 where conditions are same as in Comparative example 1 except use of antifoaming agent, because the foaming at the liquid surface in the evaporating tank was so terrible that the monomer reducing process could not be operated stably. In case (Comparative example 2) that a silicone antifoaming agent was used; the treatment by stripping could be processed stably, but properties of the resultant toner deteriorate; the charge amount diminished, the likelihood of fog swelled, and printing density likely lightened or varied.

In contrast with the above, according to the methods of the present invention (Example 1 through 4), the treatments by stripping were processed stably with lower foaming, the content of remaining monomer is reduced sufficiently, and such toner for electrophotography use was produced that was remarkably improved in charge amount, likelihood of fog, and printing density.

INDUSTRIAL APPLICABILITY

The present invention provides methods for producing polymerized toners, which methods are applicable in industry and are preferred since they are stable and easy to process. The resultant polymerized toners have excellent properties, such as improved charge amount, low likelihood of fog, and high printing density, and are useful as developers in electrophotography or electrostatic copying devices or image forming device such as laser beam printers and facsimile devices.

What is claimed is:

1. A method for producing a polymerized toner, comprising:

a process P1 of producing a dispersion of colored polymer particles, the process comprising a step S1 of polymerizing a polymerizable composition in an aqueous dispersion medium, which polymerizable composition has a colorant and a polymerizable monomer;

a process P2 of reducing the remaining polymerizable monomer from the colored polymer particles, the dispersion being treated by stripping in the presence of at least one antifoaming agent selected from a group consisting of fats-and-oils antifoaming agents, mineral oil antifoaming agents, polyether antifoaming agents, polyalkyleneglycol nonionic surfactants, emulsions consisting of fats-and-oils and polyalkyleneglycol nonionic surfactants, and emulsions consisting of mineral oils and polyalkyleneglycol antifoaming agents; and a process P3 of removing the colored polymer particles from the dispersion after treating by stripping.

2. A method for producing a core-shell structure polymerized toner, comprising:

a process P1 of producing a dispersion of colored polymer particles, the process comprising the steps of:

a step S1 of polymerizing a polymerizable composition in an aqueous dispersion medium, which polymerizable composition has a colorant and a polymerizable monomer; and a subsequent step S2 of polymerizing a polymerizable monomer in the presence of the resultant colored polymer particles of the step S1;

a process P2 of reducing the remaining polymerizable monomer from the colored polymer particles, the dispersion being treated by stripping in the presence of at least one antifoaming agent selected from a group consisting of fats-and-oils antifoaming agents, mineral oil antifoaming agents, polyether antifoaming agents, polyalkyleneglycol nonionic surfactants, emulsions consisting of fats-and-oils and polyalkyleneglycol nonionic surfactants, and emulsions consisting of mineral oils and polyalkyleneglycol antifoaming agents; and a process P3 of removing the colored polymer particles from the dispersion after treating by stripping.

3. The method according to claim 1 or 2, wherein:

the antifoaming agent is selected from a group consisting of mineral oil antifoaming agents, polyalkyleneglycol nonionic surfactants, emulsions consisting of fats-and-oils and polyalkyleneglycol nonionic surfactants.

4. The method according to claim 1 or 2, wherein:

the antifoaming agent is used in the portion of 0.01–1 parts by weight per 100 parts by weight of the colored polymer particles.

5. The method according to claim 1 or 2, wherein:

the treatment by stripping is achieved as the dispersion is agitating.

6. The method according to claim 1 or 2, wherein:

the treatment by stripping is achieved at the temperature of the dispersion in the range of not lower than Tg of the polymer making up the colored polymer particles and lower than 100° C.

7. The method according to claim 1 or 2, wherein:

the treatment by stripping is a bubbling treatment.

8. The method according to claim 7, wherein:

the treatment by stripping is achieved at a pressure inside the evaporating tank in the range of 70–105 kPa.

9. The method according to claim 1 or 2, wherein:

the treatment by stripping is by stripping under reduced pressure.

10. The method according to claim 9, wherein:

the treatment by stripping is achieved at a pressure inside the evaporating tank in the range of 5–70 kPa.

11. A method for producing a polymerized toner, comprising:

a process P1 of producing a dispersion of colored polymer particles, the process comprising a step S1 of polymerizing a polymerizable composition in an aqueous dispersion medium, which polymerizable composition has a colorant and a polymerizable monomer wherein the polymerization is achieved until conversion ratio thereof reaches more than 90%;

a process P2 of reducing the remaining polymerizable monomer from the colored polymer particles, the dispersion being treated by stripping in the presence of at least one antifoaming agent selected from a group consisting of fats-and-oils antifoaming agents, mineral oil antifoaming agents, polyether antifoaming agents, polyalkyleneglycol nonionic surfactants, emulsions consisting of fats-and-oils and polyalkyleneglycol nonionic surfactants, and emulsions consisting of mineral oils and polyalkyleneglycol antifoaming agents; and a process P3 of removing the colored polymer particles from the dispersion after treating by stripping.

12. A method for producing a core-shell structure polymerized toner, comprising:

a process P1 of producing a dispersion of colored polymer particles, the process comprising the steps of:

a step S1 of polymerizing a polymerizable composition in an aqueous dispersion medium, which polymerizable composition has a colorant and a polymerizable monomer, wherein the polymerization is achieved until conversion ratio thereof reaches more than 90%;

a subsequent step S2 of polymerizing a polymerizable monomer in the presence of the resultant colored polymer particles of the step S1, wherein the polymerization is achieved until conversion ratio thereof reaches more than 90%;

a process P2 of reducing the remaining polymerizable monomer from the colored polymer particles, the dispersion being treated by stripping in the presence of at least one antifoaming agent selected from a group consisting of fats-and-oils antifoaming agents, mineral oil antifoaming agents, polyether antifoaming agents, polyalkyleneglycol nonionic surfactants, emulsions consisting of fats-and-oils and polyalkyleneglycol nonionic surfactants, and emulsions consisting of mineral oils and polyalkyleneglycol antifoaming agents; and a process P3 of removing the colored polymer particles from the dispersion after treating by stripping.

13. The method according to claim 11 or 12, wherein the process P2 further comprises the step of diluting the dispersion with the aqueous dispersion medium before the dispersion is treated by stripping.

* * * * *